US011560768B2

(12) United States Patent
Fripp et al.

(10) Patent No.: US 11,560,768 B2
(45) **Date of Patent: *Jan. 24, 2023**

(54) WASHOUT PREVENTION ELEMENT FOR EXPANDABLE METAL SEALING ELEMENTS

(71) Applicant: Halliburton Energy Services, Inc., Houston, TX (US)

(72) Inventors: Michael Linley Fripp, Carrollton, TX (US); Stephen Michael Greci, Little Elm, TX (US); Abdel Hamid R Abeidoh, Dallas, TX (US); Christopher Michael Pelto, Garland, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/184,268

(22) Filed: Feb. 24, 2021

(65) Prior Publication Data

US 2021/0198973 A1 Jul. 1, 2021

Related U.S. Application Data

(63) Continuation of application No. 16/655,052, filed on Oct. 16, 2019, now Pat. No. 10,961,804.

(51) Int. Cl.
*E21B 33/12* (2006.01)
*E21B 23/06* (2006.01)

(52) U.S. Cl.
CPC ..... *E21B 33/1212* (2013.01); *E21B 23/06* (2013.01); *E21B 2200/01* (2020.05)

(58) Field of Classification Search
CPC .. E21B 33/1212; E21B 23/06; E21B 2200/01; E21B 33/12
See application file for complete search history.

(56) References Cited

U.S. PATENT DOCUMENTS 1,982,569 A 11/1934 Byrd
3,046,601 A 7/1962 Hubbert et al.
(Continued)

FOREIGN PATENT DOCUMENTS

CA 2751473 A1 8/2010
CA 2751473 C 9/2014
(Continued)

OTHER PUBLICATIONS

International Search Report and Written Opinion dated Jul. 8, 2020, issued in related International Application No. PCT/US2019/056814.

(Continued)

*Primary Examiner* — Taras P Bemko
(74) *Attorney, Agent, or Firm* — McGuireWoods LLP

(57) ABSTRACT

Methods for positioning an expandable metal sealing element in the wellbore. An example method includes an expandable metal sealing element having a reactive metal and disposed in a location. The method further includes actuating a washout prevention element, contacting the expandable metal sealing element with a fluid that reacts with the reactive metal to produce a reaction product having a volume greater than the reactive metal, and allowing the washout prevention element to prevent at least a portion of the reaction product from flowing away from the location.

20 Claims, 10 Drawing Sheets

(56) References Cited

U.S. PATENT DOCUMENTS 3,385,367 A 5/1968 Kollsman
4,445,694 A 5/1984 Flaherty
4,612,985 A 9/1986 Rubbo et al.
4,846,278 A 7/1989 Robbins
5,139,235 A 8/1992 Kilmer
5,163,321 A 11/1992 Perales
5,803,177 A 9/1998 Hriscu et al.
6,098,717 A 8/2000 Bailey et al.
6,321,861 B1 11/2001 Leichter
6,367,845 B1 4/2002 Otten et al.
6,581,682 B1 6/2003 Parent et al.
6,640,893 B1 11/2003 Rummel et al.
6,695,061 B2 2/2004 Fripp et al.
7,007,910 B1 3/2006 Krinner et al.
7,040,404 B2 5/2006 Brothers et al.
7,387,158 B2 6/2008 Murray et al.
7,431,082 B2 10/2008 Holt et al.
7,562,704 B2 7/2009 Wood et al.
7,578,347 B2 8/2009 Bosma et al.
7,591,319 B2 9/2009 Xu
7,909,110 B2 3/2011 Sharma et al.
7,931,079 B2 4/2011 Nicholson
7,984,762 B2 7/2011 Renshaw et al.
8,083,000 B2 12/2011 Nutley et al.
8,434,571 B2 5/2013 Kannan et al.
8,443,881 B2 5/2013 Thomson et al.
8,490,707 B2 7/2013 Robisson et al.
8,499,843 B2 8/2013 Patel et al.
8,776,899 B2 7/2014 Fripp et al.
9,033,046 B2 5/2015 Andrew et al.
9,091,133 B2 7/2015 Stewart et al.
9,133,683 B2 9/2015 Dyer et al.
9,404,030 B2 8/2016 Mazyar et al.
9,518,453 B2 12/2016 Dilber et al.
9,605,508 B2 3/2017 Ku et al.
9,624,752 B2 4/2017 Resink
9,725,979 B2 8/2017 Mazyar et al.
9,745,451 B2 8/2017 Zhao et al.
9,856,710 B2 1/2018 Zhu et al.
9,869,152 B2 1/2018 Gamstedt et al.
9,976,380 B2 5/2018 Davis et al.
10,119,011 B2 11/2018 Zhao et al.
10,364,636 B2 7/2019 Davis et al.
10,428,624 B2 10/2019 Masques
10,704,362 B2 7/2020 Themig et al.
10,851,615 B2 12/2020 Watson et al.
2002/0125008 A1 9/2002 Wetzel et al.
2003/0150614 A1 8/2003 Brown et al.
2003/0159829 A1 8/2003 Fripp et al.
2004/0118572 A1 6/2004 Whanger et al.
2004/0149418 A1 8/2004 Bosma et al.
2004/0244994 A1 12/2004 Jackson
2005/0039927 A1 2/2005 Wetzel et al.
2005/0092485 A1 5/2005 Brezinski et al.
2005/0199401 A1 9/2005 Patel et al.
2005/0257961 A1 11/2005 Snell et al.
2006/0175065 A1 8/2006 Ross
2007/0089911 A1 4/2007 Moyes
2007/0125532 A1 6/2007 Murray et al.
2007/0200299 A1 8/2007 Kunz
2007/0257405 A1 11/2007 Freyer
2008/0066931 A1 3/2008 Ku
2008/0142214 A1 6/2008 Keller
2008/0149351 A1 6/2008 Marya et al.
2008/0185150 A1 8/2008 Brown
2008/0185158 A1 8/2008 Chalker et al.
2008/0220991 A1 9/2008 Slay et al.
2009/0120640 A1 5/2009 Kulakofsky et al.
2009/0130938 A1 5/2009 Ku et al.
2009/0173505 A1 7/2009 Patel et al.
2009/0179383 A1 7/2009 Koloy et al.
2009/0242189 A1 10/2009 Vaidya et al.
2009/0242214 A1 10/2009 Foster et al.
2009/0272546 A1 11/2009 Nutley et al.
2009/0277651 A1 11/2009 Kilgore
2009/0277652 A1 11/2009 Nutley et al.
2010/0038074 A1 2/2010 Patel
2010/0139930 A1 6/2010 Patel et al.
2010/0163252 A1 7/2010 Regnault De La Mothe et al.
2010/0212891 A1 8/2010 Stewart et al.
2010/0270031 A1 10/2010 Patel
2010/0307770 A1 12/2010 Sponchia et al.
2011/0073310 A1 3/2011 Clemens et al.
2011/0098202 A1 4/2011 James et al.
2011/0174504 A1 7/2011 Wright et al.
2011/0226374 A1 9/2011 Kalman et al.
2011/0252879 A1 10/2011 Madhavan et al.
2012/0006530 A1 1/2012 Crabb et al.
2012/0055667 A1 3/2012 Ingram et al.
2012/0175134 A1 7/2012 Robisson et al.
2012/0205092 A1 8/2012 Givens et al.
2012/0292013 A1 11/2012 Munshi et al.
2012/0292023 A1 11/2012 Hinkie et al.
2012/0318513 A1 12/2012 Mazyar et al.
2013/0056196 A1 3/2013 Hench
2013/0056227 A1 3/2013 Sponchia
2013/0056228 A1* 3/2013 Gruetzmann ..... E21B 33/126 166/387
2013/0146312 A1 6/2013 Gerrard et al.
2013/0248179 A1 9/2013 Veh et al.
2014/0051612 A1 2/2014 Mazyar et al.
2014/0054047 A1 2/2014 Zhou
2014/0060815 A1 3/2014 Wang et al.
2014/0102728 A1 4/2014 Gamstedt et al.
2014/0231086 A1 8/2014 Jamison et al.
2014/0238692 A1 8/2014 Watson
2014/0251641 A1 9/2014 Marya et al.
2014/0262351 A1 9/2014 Derby
2014/0318780 A1 10/2014 Howard
2014/0354443 A1 12/2014 Roberson et al.
2014/0361497 A1 12/2014 Porta
2015/0021044 A1 1/2015 Davis et al.
2015/0060064 A1 3/2015 Lafferty et al.
2015/0101813 A1 4/2015 Zhao et al.
2015/0199401 A1 7/2015 Polehn et al.
2015/0275644 A1 10/2015 Chen et al.
2015/0308214 A1 10/2015 Bilansky et al.
2015/0344772 A1 12/2015 Drager et al.
2015/0369027 A1 12/2015 Jones et al.
2016/0137912 A1 5/2016 Sherman et al.
2016/0138359 A1 5/2016 Zhao et al.
2016/0145965 A1 5/2016 Zhao et al.
2016/0194933 A1 7/2016 O'Brien et al.
2016/0201425 A1 7/2016 Walton et al.
2016/0215604 A1 7/2016 Potapenko et al.
2016/0230495 A1 8/2016 Mazyar et al.
2016/0319633 A1 11/2016 Cooper et al.
2016/0376869 A1 12/2016 Rochen et al.
2016/0376870 A1 12/2016 Reseller et al.
2017/0122062 A1 5/2017 Freyer
2017/0191343 A1 7/2017 Solhaug
2017/0234103 A1 8/2017 Frazier
2017/0335673 A1 11/2017 Burke et al.
2018/0078998 A1 3/2018 Sherman
2018/0085154 A1 3/2018 Kuiper et al.
2018/0087346 A1 3/2018 Rochen
2018/0087350 A1 3/2018 Sherman
2018/0266215 A1 9/2018 Fagley, IV et al.
2018/0355693 A1 12/2018 Al-Abduljabbar et al.
2019/0017285 A1 1/2019 Kain
2019/0055808 A1 2/2019 Krueger
2019/0128074 A1 5/2019 Stokes et al.
2019/0153852 A1 5/2019 Lallemand et al.
2019/0203101 A1 7/2019 Dusterhoft et al.
2019/0249509 A1 8/2019 Jakkula et al.
2019/0360297 A1 11/2019 Heiman et al.
2021/0017441 A1 1/2021 Fripp et al.
2021/0079756 A1* 3/2021 Ornelaz ..... E21B 33/128
2021/0140255 A1 5/2021 Greci et al.
2021/0189817 A1 6/2021 Fripp et al.
2021/0332659 A1* 10/2021 Fripp ..... E21B 33/1208
2021/0353037 A1 11/2021 Cote
2022/0074221 A1 3/2022 Laimbeer et al.

(56) References Cited

U.S. PATENT DOCUMENTS

FOREIGN PATENT DOCUMENTS

| | | | |
|---|---|---|---|
| CN | 1708631 | A | 12/2005 |
| CN | 102027189 | A | 4/2011 |
| CN | 104583530 | A | 4/2015 |
| CN | 105422146 | A | 3/2016 |
| CN | 106522923 | A | 3/2017 |
| CN | 107148444 | A | 9/2017 |
| CN | 107250321 | A | 10/2017 |
| CN | 107532466 | A | 1/2018 |
| EP | 2399000 | A2 | 12/2011 |
| EP | 2753791 | B1 | 6/2017 |
| FR | 3073549 | A1 | 5/2019 |
| GB | 2381278 | A | 4/2003 |
| GB | 2469723 | A | 10/2010 |
| GB | 2514195 | B | 6/2019 |
| GB | 2583232 | A | 10/2020 |
| GB | 2557397 | B | 8/2021 |
| MX | 2011008597 | A | 9/2011 |
| RU | 2424419 | C1 | 7/2011 |
| RU | 2588501 | C2 | 6/2016 |
| RU | 182236 | U1 | 8/2018 |
| WO | 3026501 | A1 | 5/2000 |
| WO | 2008079486 | A1 | 7/2008 |
| WO | 2010096417 | A2 | 8/2010 |
| WO | 2012090056 | A2 | 7/2012 |
| WO | 2013033208 | A1 | 3/2013 |
| WO | 2014098885 | A1 | 6/2014 |
| WO | 2014110382 | A1 | 7/2014 |
| WO | 2016171666 | A1 | 10/2016 |
| WO | 2018005740 | A1 | 1/2018 |
| WO | 2018085102 | A1 | 5/2018 |
| WO | 2018147833 | A1 | 8/2018 |
| WO | 2019094044 | A1 | 5/2019 |
| WO | 2019147285 | A1 | 8/2019 |
| WO | 2019164492 | A1 | 8/2019 |
| WO | 2019164499 | A1 | 8/2019 |
| WO | 2020005252 | A1 | 1/2020 |
| WO | 2020018110 | A1 | 1/2020 |
| WO | 2020068037 | A1 | 4/2020 |
| WO | 2021021203 | A1 | 2/2021 |
| WO | 2021076141 | A1 | 4/2021 |

OTHER PUBLICATIONS

Dutch Search Report issued in NL 2026726, dated Aug. 13, 2021.
International Search Report and Written Opinion issued Sep. 8, 2021 in PCT/US2020/066193.
Written Opinion and Search Report in SG Appln No. 11202000316S, dated Aug. 30, 2021.
Dutch Search Report in NL Appln No. 2026737, dated Aug. 13, 2021.
Examination Report in GCC Appln No. GC 2020-39914, dated Jul. 29, 2021.
Office Action in CA Appln No. 3,070,929, dated Jul. 9, 2021.
International Search Report & Written Opinion in PCT/US2019/042074 mailed Apr. 10, 2020.
Search Report in NL Appln No. 2025837, dated Sep. 23, 2021.
Office Action in CA Application No. 3,070,929 dated Nov. 19, 2021.
International Search Report & Written Opinion in PCT/US2019/017538, mailed Nov. 11, 2019.
Chinese Search Report date mailed Dec. 17, 2021; CN Application No. 2018800875885.
International Search Report and Written Opinion mailed Nov. 19, 2018; International PCT Application No. PCT/JS2018/019337.
Denmark Examination Report and Search Report date mailed Mar. 16, 2021, Denmark Application No. PA202070389.
International Search Report and Written Opinion mailed Aug. 2, 2018, International PCT Application No. PCT/US2017/061307.
Search Report in FR Application No. 1859379, mailed Oct. 15, 2019.
International Search Report and Written Opinion for corresponding PCT International Application No. PCT/US2019/068497; mailed Sep. 17, 2020.
International Search report and Written Opinion for corresponding International Patent Application No. PCT/US2019/062225, mailed Aug. 11, 2020.
International Search report and Written Opinion issued in related PCT/US2019/068493 issued Sep. 15, 2020.
NEMISIS Annulus Swellable Packer, Weatherford, Swellable Products, 2009-2011.
Examination Report in GB Appln No. 2010931.0 dated, Janaury 18, 2022.
International Search Report & Written Opinion in PCT/US2020/065539, mailed Aug. 30, 2021.
International Search Report & Written Opinion in PCT/US2019/058904, mailed Jul. 23, 2020.
Netherlands Search Report in Application No. 2025954, dated Mar. 2, 2021.
International Search Report and Written Opinion in PCT/US2019/044542, mailed Apr. 28, 2020.
Examination Report in GCC Application No. GC 2020-40201, mailed Aug. 31, 2021.
French Search Report issued in FR Appln No. FR2006166, dated May 30, 2022.
International Search Report & Written Opinion in PCT/US2021/048628 dated May 19, 2022.
International Search Report & Written Opinion in PCT/US2021/027245 mailed Jan. 10, 2022.
International Search Report and Written Opinion in PCT/US2021/032983, mailed Feb. 10, 2022.
Netherlands Search Report in Application No. 2026573 dated Aug. 20, 2021.
Russian Office Action in RU Application No. 2021121198, mailed Nov. 25, 2021.
GC Examination Report in GC Application No. 2019-38908, mailed Nov. 4, 2020.
GC Examination Report in GC Application No. 2020-40475, mailed Nov. 25, 2021.
MY Search Report in MY Application No. PI2020003430, mailed May 26, 2022.
GB Examination Report in Application No. 2010931.0 dated Apr. 5, 2022.
DK Examination Report in Application No. PA 202070389, mailed Oct. 20, 2021.
International Preliminary Report on Patentability in PCT/US2019/068493, mailed Jun. 30, 2022.
International Preliminary Report on Patentability in PCT/US2019/068497, mailed Jun. 30, 2022.

* cited by examiner

WASHOUT PREVENTION ELEMENT FOR EXPANDABLE METAL SEALING ELEMENTS

TECHNICAL FIELD

The present disclosure relates to washout prevention of expandable metal sealing elements, and more particularly, to the use of a washout prevention element to prevent the washout of the reaction product of the expandable metal sealing element due to flow across the expandable metal sealing element.

BACKGROUND

Sealing elements may be used for a variety of wellbore applications including forming annular seals in and around conduits in wellbore environments. Typically, sealing elements comprise swellable materials that may swell if contacted with specific swell-inducing fluids. An example of these swellable sealing elements are swell packers that may form annular seals in both open and cased wellbores. The annular seal may restrict all or a portion of fluid and/or pressure communication at the seal interface. Seal formation is an important part of wellbore operations at all stages of drilling, completion, and production.

Many species of the aforementioned swellable materials comprise elastomers. Elastomers, such as rubber, swell when contacted with a swell-inducing fluid. The swell-inducing fluid may diffuse into the elastomer where a portion may be retained within the internal structure of the elastomer. Swellable materials such as elastomers may be limited to use in specific wellbore environments, for example, those without high salinity and/or high temperatures. The present disclosure provides improved apparatus and methods for sealing elements and for forming seals in wellbore applications.

BRIEF DESCRIPTION OF THE DRAWINGS

Illustrative examples of the present disclosure are described in detail below with reference to the attached drawing figures, which are incorporated by reference herein, and wherein.

Figure 1:
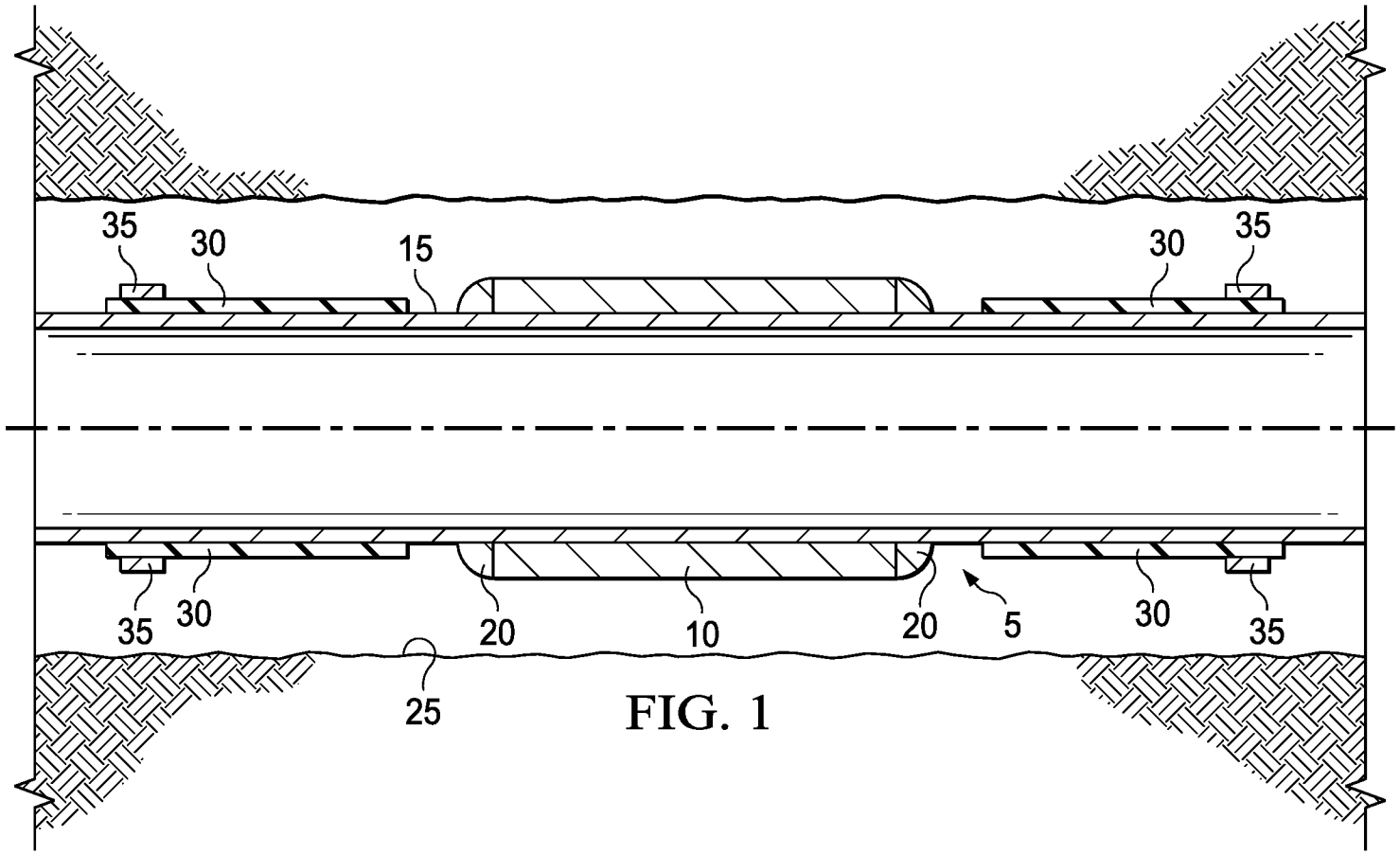
FIG. 1 is a cross-section illustration of an example wellbore sealing system in accordance with the examples disclosed herein.

The illustrated figures are only exemplary and are not intended to assert or imply any limitation with regard to the environment, architecture, design, or process in which different examples may be implemented.

DETAILED DESCRIPTION

The present disclosure relates to washout prevention of expandable metal sealing elements, and more particularly, to the use of a washout prevention element to prevent the washout of the reaction product of the expandable metal sealing element due to flow across the expandable metal sealing element.

In the following detailed description of several illustrative examples, reference is made to the accompanying drawings that form a part hereof, and in which is shown by way of illustration examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples is defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present disclosure. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

Examples of the methods and systems described herein relate to the use of sealing elements comprising reactive metals. As used herein, "sealing elements" refers to any element used to form a seal. A "seal" is a barrier to the passage of a liquid and/or gas. In some examples, the metal sealing elements described herein may form a seal that complies with the International Organization for Standardization (ISO) 14310:2001/API Specification 11D1 1$^{st}$ Edition validation standard for the Grade V5: Liquid Test. The metal sealing elements expand by reacting the reactive metal with a specific reaction-inducing fluid to produce a reaction product having a larger volume than the base reactive metal reactant. By "expand," "expanding," or "expandable" it is meant that the expandable metal sealing element increases its volume as the reactive metal reacts with the reaction-inducing fluid, such as a brine. This reaction induces the formation of the reaction products resulting in the volumetric expansion of the metal sealing element as these reaction products are formed. The reaction products of the expandable metal and the reaction-inducing fluid occupy more volumetric space than the unreacted reactive metal, and thus the metal sealing element expands outward as the reaction of the reactive metal with the reaction-inducing fluid proceeds. Advantageously, the reactive metal sealing elements may be used in a variety of wellbore applications where an irreversible seal is desired. Yet a further advantage is that the expandable metal sealing elements may swell in high-salinity and/or high-temperature environments that may be unsuitable for some other species of sealing elements. An additional advantage is that the expandable metal sealing elements comprise a wide variety of metals and metal alloys and may expand upon contact with reaction-inducing fluids, including a variety of wellbore fluids. Another advantage is that the expandable metal sealing elements may be used as replacements for other types of sealing elements (e.g., elastomeric sealing elements), or they may be used as backups for other types of sealing elements. One other advantage is that a washout prevention element may be used to prevent the washout of the reaction products before they solidify into a seal. A still further advantage is that the washout prevention element may be temporary or permanent as desired. As an additional benefit in some examples, the washout prevention element may be degraded upon formation of the seal. Another advantage is that the expandable metal sealing element and the washout prevention element may be used on a wide variety of wellbore conduits and downhole tools including tubing, casing, liners, liner hangers, and the like.

The expandable metal sealing element comprises a reactive metal that undergoes a reaction in the presence of a reaction-inducing fluid (e.g., a brine) to form a reaction product (e.g., metal hydroxides). The resulting reaction products occupy more volumetric space relative to the base reactive metal reactant. This difference in volume allows the metal sealing element to be expandable so that it may form a seal at the interface of the expanded metal sealing element and any adjacent surface. Magnesium may be used to illustrate the volumetric expansion of the reactive metal as it undergoes reaction with the reaction-inducing fluid. A mole of magnesium has a molar mass of 24 g/mol and a density of 1.74 g/cm$^3$, resulting in a volume of 13.8 cm$^3$/mol. Magnesium hydroxide, the reaction product of magnesium and an aqueous reaction-inducing fluid, has a molar mass of 60 g/mol and a density of 2.34 g/cm$^3$, resulting in a volume of 25.6 cm$^3$/mol. The magnesium hydroxide volume of 25.6 cm$^3$/mol is an 85% increase in volume over the 13.8 cm$^3$/mol volume of the mole of magnesium. As another example, a mole of calcium has a molar mass of 40 g/mol and a density of 1.54 g/cm$^3$, resulting in a volume of 26.0 cm$^3$/mol. Calcium hydroxide, the reaction product of calcium and an aqueous reaction-inducing fluid, has a molar mass of 76 g/mol and a density of 2.21 g/cm$^3$, resulting in a volume of 34.4 cm$^3$/mol. The calcium hydroxide volume of 34.4 cm$^3$/mol is a 32% increase in volume over the 26.0 cm$^3$/mol volume of the mole of calcium. As yet another example, a mole of aluminum has a molar mass of 27 g/mol and a density of 2.7 g/cm$^3$, resulting in a volume of 10.0 cm$^3$/mol. Aluminum hydroxide, the reaction product of aluminum and an aqueous reaction-inducing fluid, has a molar mass of 63 g/mol and a density of 2.42 g/cm$^3$ resulting in a volume of 26 cm$^3$/mol. The aluminum hydroxide volume of 26 cm$^3$/mol is a 160% increase in volume over the 10 cm$^3$/mol volume of the mole of aluminum. The reactive metal may comprise any metal or metal alloy that undergoes a reaction to form a reaction product having a greater volume than the base reactive metal or alloy reactant.

Examples of suitable metals for the reactive metal include, but are not limited to, magnesium, calcium, aluminum, tin, zinc, beryllium, barium, manganese, or any combination thereof. Preferred metals include magnesium, calcium, and aluminum.

Examples of suitable metal alloys for the reactive metal include, but are not limited to, alloys of magnesium, calcium, aluminum, tin, zinc, beryllium, barium, manganese, or any combination thereof. Preferred metal alloys include alloys of magnesium-zinc, magnesium-aluminum, calcium-magnesium, or aluminum-copper. In some examples, the metal alloys may comprise alloyed elements that are not metallic. Examples of these non-metallic elements include, but are not limited to, graphite, carbon, silicon, boron nitride, and the like. In some examples, the metal is alloyed to increase reactivity and/or to control the formation of oxides.

In some examples, the metal alloy is also alloyed with a dopant metal that promotes corrosion or inhibits passivation and thus increases hydroxide formation. Examples of dopant metals include, but are not limited to, nickel, iron, copper, carbon, titanium, gallium, mercury, cobalt, iridium, gold, palladium, or any combination thereof.

In some examples, the reactive metal comprises an oxide. As an example, calcium oxide reacts with water in an energetic reaction to produce calcium hydroxide. One mole of calcium oxide occupies 9.5 $cm^3$, whereas one mole of calcium hydroxide occupies 34.4 $cm^3$. This is a 260% volumetric expansion of the mole of calcium oxide relative to the mole of calcium hydroxide. Examples of metal oxides suitable for the reactive metal may include, but are not limited to, oxides of any metals disclosed herein, including magnesium, calcium, aluminum, iron, nickel, copper, chromium, tin, zinc, lead, beryllium, barium, gallium, indium, bismuth, titanium, manganese, cobalt, or any combination thereof.

It is to be understood that the selected reactive metal is chosen such that the formed expandable metal sealing element does not dissolve or otherwise degrade in the reaction-inducing fluid. As such, the use of metals or metal alloys for the reactive metal that form relatively insoluble reaction products in the reaction-inducing fluid may be preferred. As an example, the magnesium hydroxide and calcium hydroxide reaction products have very low solubility in water. As an alternative or an addition, the expandable metal sealing element may be positioned and configured in a way that constrains the degradation of the expandable metal sealing element in the reaction-inducing fluid due to the geometry of the area in which the expandable metal sealing element is disposed. This may result in reduced exposure of the expandable metal sealing element to the reaction-inducing fluid, but may also reduce degradation of the reaction product of the expandable metal sealing element, thereby prolonging the life of the formed seal. As an example, the volume of the area in which the expandable metal sealing element is disposed may be less than the potential expansion volume of the volume of reactive metal disposed in said area. In some examples, this volume of area may be less than as much as 50% of the expansion volume of reactive metal. Alternatively, this volume of area may be less than 90% of the expansion volume of reactive metal. As another alternative, this volume of area may be less than 80% of the expansion volume of reactive metal. As another alternative, this volume of area may be less than 70% of the expansion volume of reactive metal. As another alternative, this volume of area may be less than 60% of the expansion volume of reactive metal. In a specific example, a portion of the expandable metal sealing element may be disposed in a recess within the body of the conduit or downhole tool. In addition to some of these examples, the washout prevention element prevents at least a portion of the reaction products from flowing downstream past the washout prevention element. In some examples, the washout prevention element may also be used to the exclusion of the constraint of a portion of the expandable metal sealing element. For example, the expandable metal sealing element may not be placed in a recess within the conduit when a washout prevention element is present.

In some examples, the formed reaction products of the reactive metal reaction may be dehydrated under sufficient pressure. For example, if a metal hydroxide is under sufficient contact pressure and resists further movement induced by additional hydroxide formation, the elevated pressure may induce dehydration of the metal hydroxide to form the metal oxide. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water.

The expandable metal sealing elements may be formed in a solid solution process, a powder metallurgy process, or through any other method as would be apparent to one of ordinary skill in the art. Regardless of the method of manufacture, the expandable metal sealing elements may be slipped over the body of the conduit or downhole tool. Once in place, the expandable metal sealing element may be held in position with end rings, stamped rings, retaining rings, set screws, or any other such method for retaining the expandable metal sealing element in position. The expandable metal sealing elements may be formed and shaped to fit over existing conduits and downhole tools and thus may not require modification of the outer diameter or profile of the conduits and downhole tools. In alternative examples, the expandable metal sealing element may be cast onto the conduit or downhole tool. In some alternative examples, the diameter of the expandable metal sealing element may be reduced (e.g., by swaging) when disposed on the conduit or downhole tool.

In some optional examples, the expandable metal sealing element may include a removable barrier coating. The removable barrier coating may be used to cover the exterior surfaces of the sealing element and prevent contact of the reactive metal with the reaction-inducing fluid. The removable barrier coating may be removed when the sealing operation is to commence. The removable barrier coating may be used to delay sealing and/or prevent premature sealing with the expandable metal sealing element. Examples of the removable barrier coating include, but are not limited to, any species of plastic shell, organic shell, paint, dissolvable coatings (e.g., solid magnesium compounds), eutectic materials, or any combination thereof. When desired, the removable barrier coating may be removed from the sealing element with any sufficient method. For example, the removable barrier coating may be removed through dissolution, a phase change induced by changing temperature, corrosion, hydrolysis, or the removable barrier coating may be time-delayed and degrade after a desired time under specific wellbore conditions. In some examples, the reaction of a portion of the reactive metal may remove support for the removable barrier coating and the removable barrier coating may collapse as the underlying reactive metal undergoes a chemical reaction with the reaction-inducing fluid.

In some optional examples, the expandable metal sealing element may include an additive which may be added to the expandable metal sealing element during manufacture as a part of the composition, or the additive may be coated onto the expandable metal sealing element after manufacturing. The additive may alter one or more properties of the reactive metal sealing element. For example, the additive may improve sealing, add texturing, improve bonding, improve gripping, etc. Examples of the additive include, but are not limited to, any species of ceramic, elastomer, glass, non-reacting metal, the like, or any combination.

The expandable metal sealing element may be used to form a seal between any adjacent surfaces that are proximate to the expandable metal sealing elements. Without limitation, the expandable metal sealing elements may be used to form seals on casing, formation surfaces, cement sheaths or layers, and the like. For example, an expandable metal sealing element may be used to form a seal between the outer diameter of a liner hanger and a surface of an adjacent casing. Alternatively, the expandable metal sealing element may be used to form a seal between the outer diameter of a conduit and a surface of an adjacent set cement layer. As another example, the expandable metal sealing element may be used to form a seal between the outer diameter of a tubing and a surface of the adjacent casing. Moreover, a plurality of the expandable metal sealing elements may be used to form multiple seals between adjacent surfaces.

As described above, the expandable metal sealing elements comprise reactive metals and as such, they are non-elastomeric materials. The reactive metals may be bent, but do not return to their original shape. As non-elastomeric materials, the expandable metal sealing elements do not contain organic compounds, and they may irreversibly expand when contacted with a reaction-inducing fluid. The expandable metal sealing elements may not return to their original size or shape even after the reaction-inducing fluid is removed from contact.

Generally, the reaction-inducing fluid induces a reaction in the reactive metal to form a reaction product that occupies more space than the unreacted reactive metal. Examples of the reaction-inducing fluid include, but are not limited to, saltwater (e.g., water containing one or more salts dissolved therein), brine (e.g., saturated saltwater, which may be produced from subterranean formations), seawater, or any combination thereof. Generally, the reaction-inducing fluid may be from any source provided that the fluid does not contain an excess of compounds that may undesirably affect other components in the expandable metal sealing element. In the case of saltwater, brines, and seawater, the reaction-inducing fluid may comprise a monovalent salt or a divalent salt. Suitable monovalent salts may include, for example, sodium chloride salt, sodium bromide salt, potassium chloride salt, potassium bromide salt, and the like. Suitable divalent salt can include, for example, magnesium chloride salt, calcium chloride salt, calcium bromide salt, and the like. In some examples, the salinity of the reaction-inducing fluid may exceed 10%. Advantageously, the expandable metal sealing elements of the present disclosure may not be impacted by contact with high-salinity fluids. One of ordinary skill in the art, with the benefit of this disclosure, should be readily able to select a reaction-inducing fluid for inducing a reaction with the reactive metal.

The expandable metal sealing elements may be used in high-temperature formations, for example, in formations with zones having temperatures equal to or exceeding 350° F. Advantageously, the use of the expandable metal sealing elements of the present disclosure may not be impacted in high-temperature formations. In some examples, the expandable metal sealing elements may be used in both high-temperature formations and with high-salinity fluids. In a specific example, an expandable metal sealing element may be positioned and used to form a seal after contact with a brine having a salinity of 10% or greater while also being disposed in a wellbore zone having a temperature equal to or exceeding 350° F.

The washout prevention element may be disposed downstream or upstream of the expandable metal sealing elements. "Downstream," as used herein, refers to a potential location of the washout prevention element relative to the expandable metal sealing element. This downstream location is the location in which the reaction products of the expandable metal sealing element would flow from fluid flow occurring across the expandable metal sealing element. This fluid flow may occur from a fluid such as the reaction-inducing fluid or any other wellbore fluid. The downstream direction is the direction of the fluid flow that carries the reaction products. "Upstream," as used herein, refers to a potential location of the washout prevention element relative to the expandable metal sealing element. In some examples, the washout prevention element may be positioned downstream of the location of the expandable metal sealing element as it is initially disposed on the conduit. The washout prevention element prevents washout of the reaction products by preventing the reaction products from flowing downstream to an area which may impact the reaction products ability to aggregate and form a hardened sealing element. In some examples, the washout prevention element may be positioned upstream of the expandable metal sealing element. The washout prevention element thus prevents fluid from flowing past the expandable metal sealing element. The washout prevention element thus forms a seal that prevents the escape of the reaction products. The reaction products may then form aggregates as the reaction proceeds thereby producing the expanded metal seal. The washout prevention element forms a seal sufficient to trap at least a portion of the reaction products; however, the formed seal may be porous and not fluid tight in some examples. Thus, the seal may allow the fluid carrying the reaction products to flow through while preventing the washout of the reaction products in said fluid.

The washout prevention element may be disposed proximate to the expandable metal sealing elements in some examples. In alternative examples, the washout prevention element may not be disposed proximate to the expandable metal sealing. The washout prevention element may be held in place on the conduit or downhole tool using end rings, stamped rings, retaining rings, set screws, or any other such method for retaining the washout prevention element in position. In some examples, the washout prevention element may be actuated separately from the expandable metal sealing element. In some examples, the washout prevention element may be actuated with the same reaction-inducing fluid that reacts with the expandable metal sealing element. In some examples, the washout prevention element may be actuated before the expandable metal sealing element. In some alternative examples, the washout prevention element may be actuated simultaneously with the expandable metal sealing element.

The washout prevention element may be temporary or permanent. If the washout prevention element is temporary, it may be degradable. If the washout prevention element is degradable, it may degrade due to temperature or chemical degradation. As an example, the washout prevention element may degrade over time in temperatures exceeding a specific threshold, such as 250° F. As another example, the washout prevention element may degrade due to hydrolysis or acid hydrolysis. As another example, the washout prevention element may dissolve in a fluid such as a wellbore fluid or an introduced solvent. As used herein, the term "degradable" encompasses dissolution of the washout prevention element. The washout prevention element may comprise any suitable material. Examples of materials may include, but are not limited to, polymeric materials, metals, composites thereof, or combinations thereof.

FIG. 1 is a cross-section illustration of an example wellbore sealing system, generally 5. Wellbore sealing system 5 comprises an expandable metal sealing element 10 disposed on a conduit 15. The expandable metal sealing element 10 may be held in place on the conduit 15 with end rings 20. End rings 20 are optional and may be substituted for other elements sufficient to maintain the expandable metal sealing element 10 in position when the conduit 15 is introduced downhole. Alternatively, the expandable metal sealing element 10 may be held in place with set screws or may be disposed in a recess precluding the need for any species of retaining ring. Conduit 15 may be any species of wellbore conduit and may comprise production tubing, drillpipe, liner, liner hanger, etc. The expandable metal sealing element 10 may seal against surface 25. Surface 25 is proximate to the expandable metal sealing element 10. Surface 25 may be the exterior surface of another conduit, a downhole tool, the wall of the subterranean formation, or a set cement layer. Washout prevention elements 30 are located downstream of the expandable metal sealing element 10. In the illustrated example, the washout prevention elements 30 are positioned on both sides of the expandable metal sealing element 10. Washout prevention elements 30 may be positioned on both sides of the expandable metal sealing element 10 when bi-directional flow is anticipated. As such, there is a washout prevention element 30 downstream of the expandable metal sealing element 10 when flow occurs in either the uphole or downhole direction. Restraints 35 may be positioned on or around washout prevention element 30 to restrain washout prevention element 30 while the conduit 15 is run in hole. Restraints 35 may be a band, clamp, strip, etc. comprising a degradable material. The degradable material may include, but is not limited to, a dissolvable salt, a dissolvable metal, a eutectic material, a degradable plastic, and any combination of materials. The restraints 35 may also take other forms, including threaded or bolted connections, so long as the removal of the connections does not impact the ability of the washout prevention element 30 to retain the reaction products produced from the expandable metal sealing element 10 reaction. The restraints 35 may degrade over time in the wellbore environment or may be actively degraded chemically with a wellbore fluid, acid, or a solvent. In some examples, the restraints 35 may comprise a different reactive metal than the expandable metal sealing element 10, and specifically may comprise a reactive metal that reacts at a faster rate than the reactive metal of the expandable metal sealing element 10. The restraints 35 may be configured to comprise a degradable material that is removed faster than the reaction rate of the expandable metal sealing element 10. As such, the restraints 35 are removed at a sufficiently fast rate to allow the washout prevention elements 30 to actuate in position to prevent the washout of the reaction products.

Figure 2:
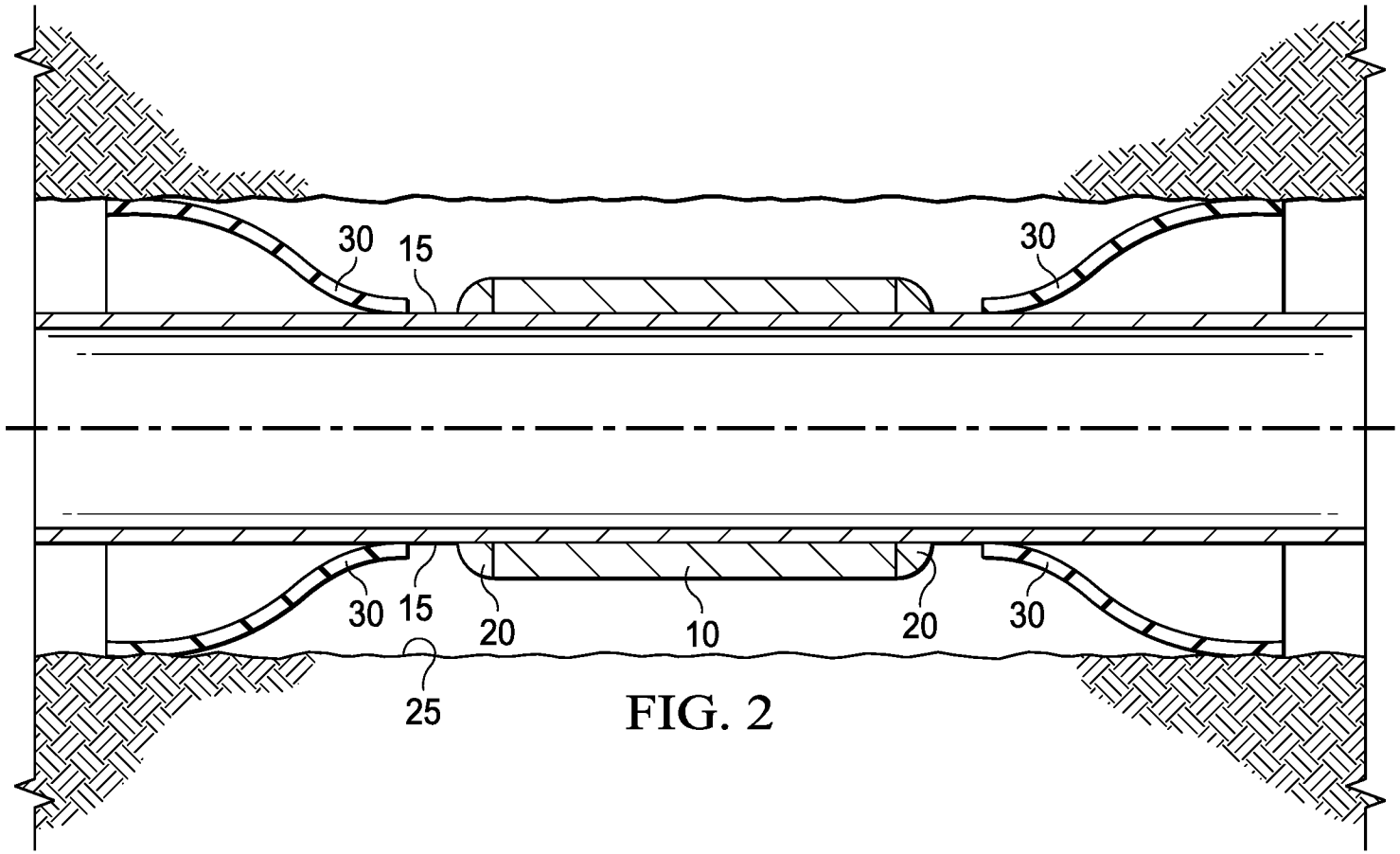
FIG. 2 is a cross-section illustration of the example wellbore sealing system of FIG. 1 after actuation of the washout prevention elements in accordance with the examples disclosed herein.

FIG. 2 is a cross-section illustration of the example wellbore sealing system 5 of FIG. 1 after actuation of the washout prevention elements 30. After removal of restraints 35 via degradation, the washout prevention elements 30 may be actuated to expand outward. As illustrated, the washout prevention elements 30 comprise cup seals, but may comprise other species of washout prevention elements 30 in other examples. Washout prevention elements 30 may be biased to spring out on its own, it may be spring energized, or it may be flow energized. In spring energized examples, the washout prevention elements 30 may be actuated by the spring force of an internal spring released upon removal of restraint 35. In flow energized examples, the washout prevention elements 30 may be energized through fluid flow into the washout prevention elements 30 to force them open. Once actuated, the washout prevention elements 30 may prevent the washout of the reaction products formed from the reaction of the expandable metal sealing element 10 and a reaction-inducing fluid. Washout may be prevented by the washout prevention elements 30 forming a seal to trap and retain the reaction products such that they do not flow downstream past the washout prevention elements 30. In some optional examples, the washout prevention elements 30 may be porous and may allow fluid flow therethrough while still retaining the reaction products. In some other optional examples, the washout prevention elements 30 may not be porous. The reaction products may then aggregate and form the expanded metal sealing element 10 to seal against the adjacent surface 25. The washout prevention elements 30 may be degraded if desired. In other examples, the washout prevention elements 30 may be permanent.

Figure 3:
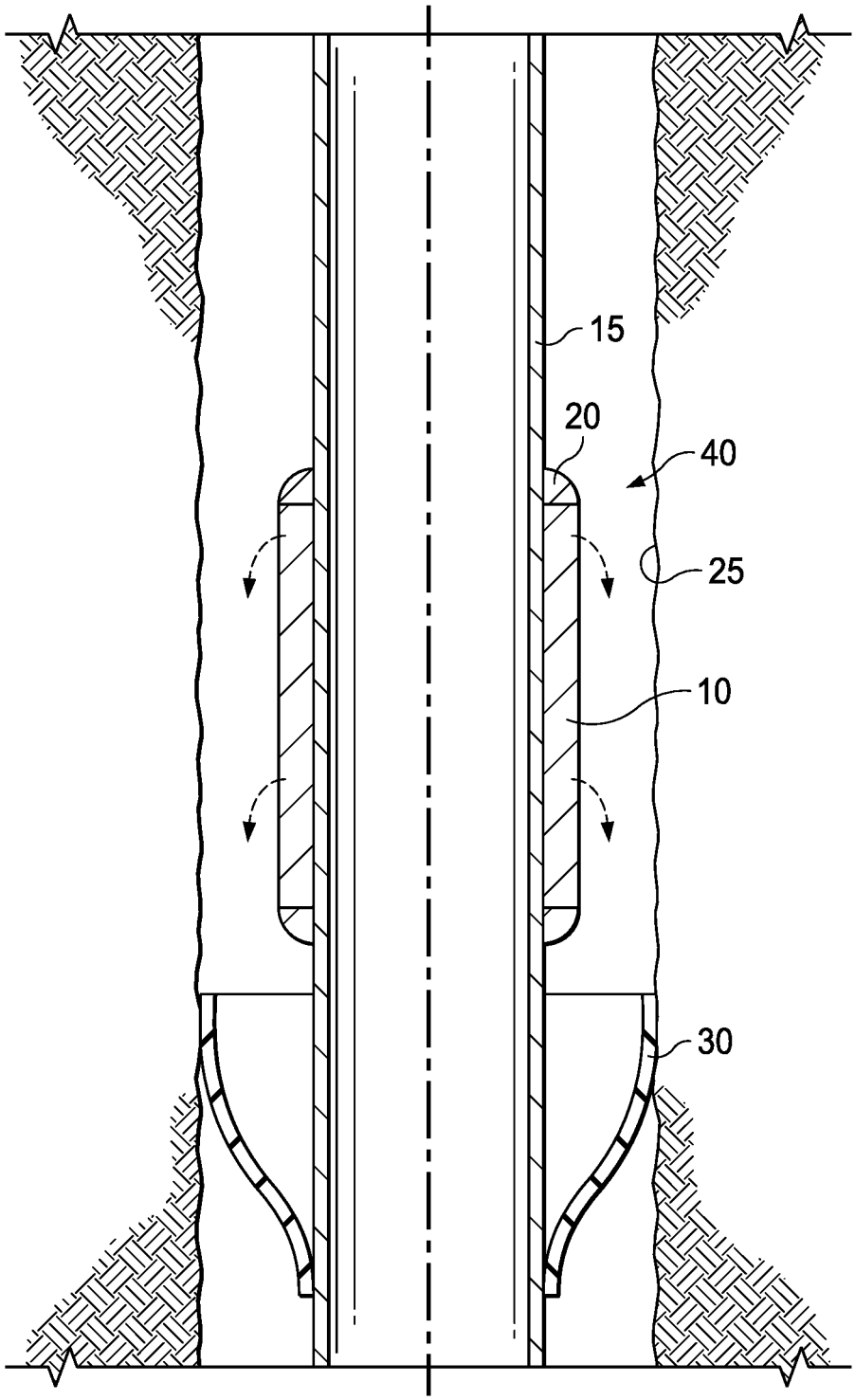
FIG. 3 is another cross-section illustration of an example wellbore sealing system in accordance with the examples disclosed herein.

FIG. 3 is a cross-section illustration of an example wellbore sealing system 40. Wellbore sealing system 40 is similar to wellbore sealing system 5 illustrated in FIGS. 1 and 2 except that the wellbore is a vertical wellbore and the orientation of the washout prevention element 30 is reversed. In the illustrated example, the washout prevention element 30 is oriented such that the cup seal opens inward in a direction facing the expandable metal sealing element 10. Due to the vertical orientation of the wellbore, the reaction products may begin to settle downstream of the initial location of the expandable metal sealing element 10. The open-facing orientation of the washout prevention element 30 may catch the reaction products in the cup portion of the washout prevention element 30 as the reaction products settle in the vertical wellbore. The reaction products may be allowed to aggregate and accumulate in the illustrated downstream location to form the seal against the surface 25. Analogously to FIGS. 1 and 2, the washout prevention element 30 may be biased, spring, or flow energized in the illustrated example of FIG. 3.

Figure 4:
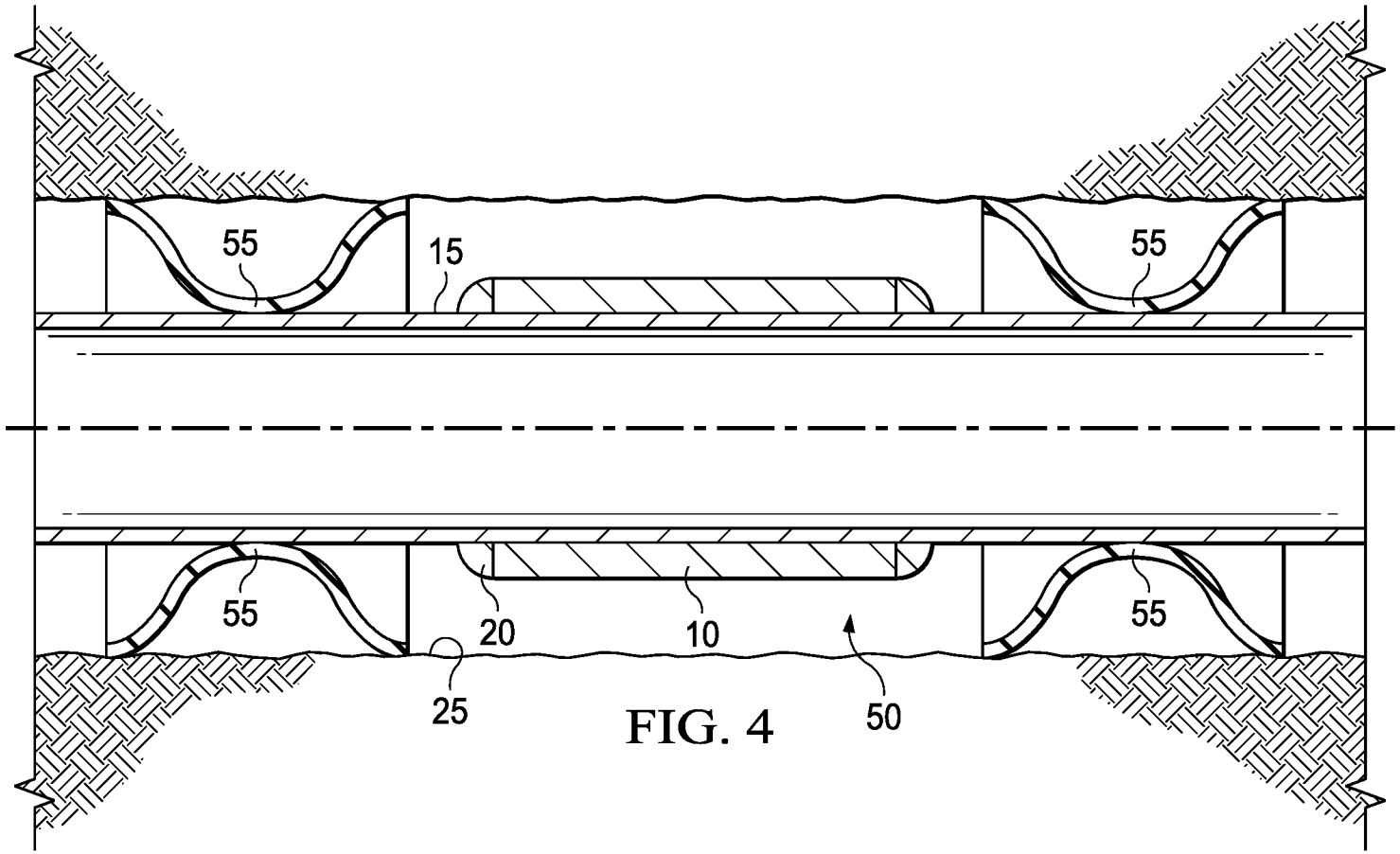
FIG. 4 is a cross-section illustration of another example wellbore sealing system in accordance with the examples disclosed herein.

FIG. 4 is a cross-section illustration of an example wellbore sealing system 50. Wellbore sealing system 50 is similar to wellbore sealing system 5 illustrated in FIGS. 1 and 2 except that the washout prevention elements 55 are bi-directional cup seals. The bi-directional cup seals may comprise a single piece comprising both cup sealing elements or may comprise two discrete cup sealing elements placed adjacent to one another in the illustrated orientation. The illustrated species of washout prevention elements 55 may be useful when bi-directional flow is anticipated or when several expandable metal sealing elements 10 are used in a series. In that specific example, the washout prevention elements 55 may be placed in-between the expandable metal sealing elements 10 in the series. A single restraint (e.g., restraint 35 as illustrated in FIG. 1) may be used which may cover the majority of the washout prevention element 55, or multiple restraints may be used to restrain each individual cup portion. Analogously to FIGS. 1 and 2, the washout prevention elements 55 may be biased, spring, or flow energized in the illustrated example of FIG. 4.

Figure 5:
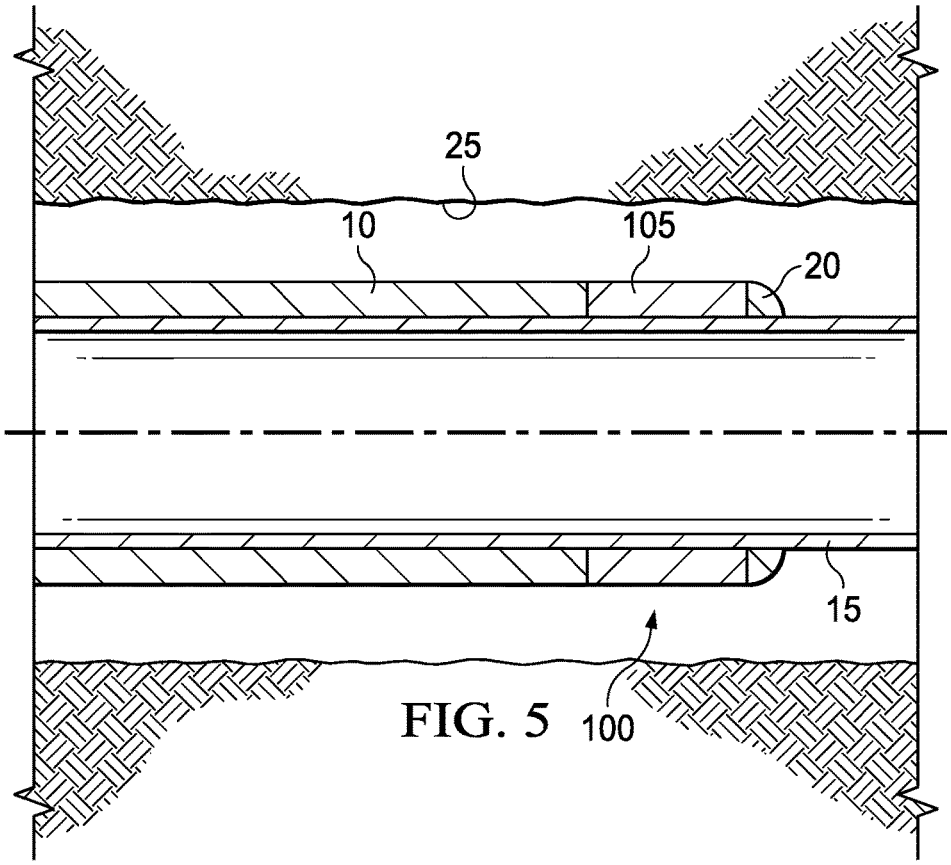
FIG. 5 is a cross-section illustration of another example wellbore sealing system in accordance with the examples disclosed herein.

FIG. 5 is a cross-section illustration of an example wellbore sealing system 100. Wellbore sealing system 100 comprises an expandable metal sealing element 10 disposed on a conduit 15. The expandable metal sealing element 10 may be held in place on the conduit 15 with end rings 20. End rings 20 are optional and may be substituted for other elements sufficient to maintain the expandable metal sealing element 10 in position when the conduit 15 is introduced downhole. Alternatively, the expandable metal sealing element 10 may be held in place with set screws or may be disposed in a recess precluding the need for any species of retaining ring. Conduit 15 may be any species of wellbore conduit and may comprise production tubing, drillpipe, liner, liner hanger, etc. The expandable metal sealing element 10 may seal against surface 25. Surface 25 is proximate to the expandable metal sealing element 10. Surface 25 may be the exterior surface of another conduit, a downhole tool, the wall of the subterranean formation, or a set cement layer. Washout prevention element 105 is located downstream of the expandable metal sealing element 10. In the illustrated example, the washout prevention element 105 is positioned on one side of the expandable metal sealing element 10 in the downstream direction. In some other examples, the washout prevention element 105 may be positioned upstream of the expandable metal sealing element 10. In some examples, a washout prevention element 105 may be positioned on both sides of the expandable metal sealing element 10 when bi-directional flow is anticipated. The washout prevention element 105 is a swellable polymeric sealing element that is tuned to swell faster than the expandable metal sealing element 10. The washout prevention elements 105 would thus swell quickly and seal the space downstream of the expandable metal sealing element 10 before the reaction products wash out. The washout prevention element 105 may swell from contact with the reaction-inducing fluid or a different fluid than the reaction-inducing fluid.

Figure 6:
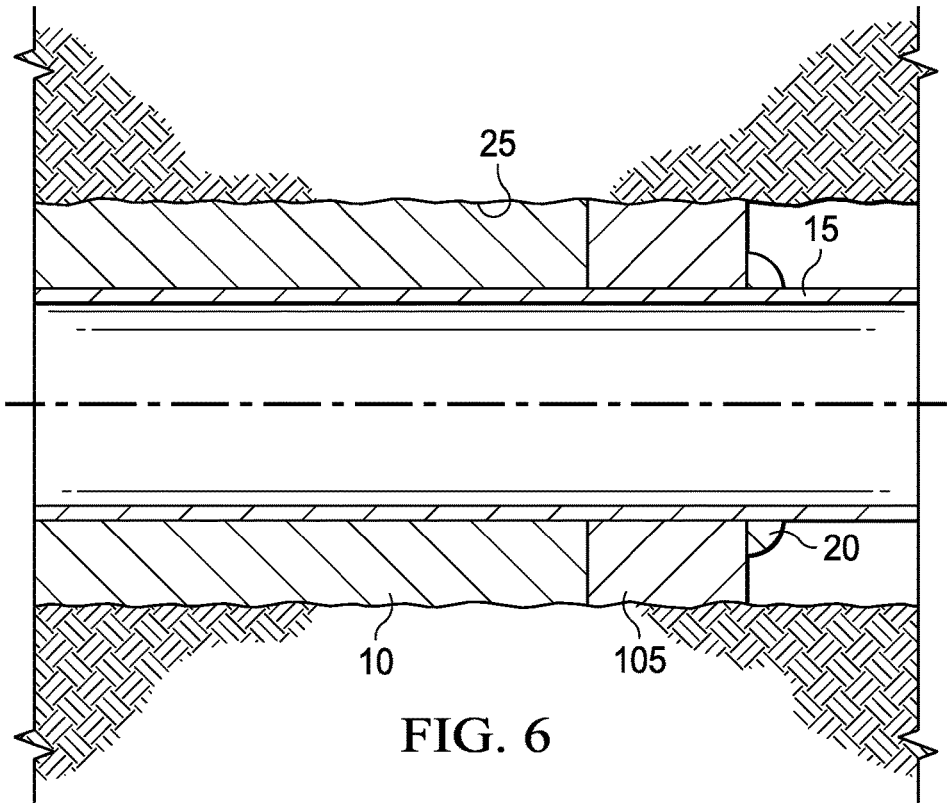
FIG. 6 is a cross-section illustration of the wellbore sealing system of FIG. 5 after expansion of the expandable metal sealing element and the swelling of the washout prevention element in accordance with the examples disclosed herein.

FIG. 6 is a cross-section illustration of the wellbore sealing system 100 of FIG. 5 after expansion of the expandable metal sealing element 10 and the swelling of the washout prevention element 105. The washout prevention element 105 may continue to swell so long as contact with a well-inducing fluid is made. If contact is removed, the washout prevention element 105 may return to its original size in some circumstances. The washout prevention element 105 may also be degradable in some examples. The washout prevention element 105 may comprise any species of swellable elastomer. The swellable elastomer may be any oil-swellable, water-swellable, and/or a combination of oil-swellable and water-swellable elastomer. The swellable elastomer may swell when exposed to a swell-inducing fluid (e.g., an oleaginous or aqueous fluid). Generally, the swellable elastomer may swell through diffusion whereby the swell-inducing fluid is absorbed into the structure of the swellable elastomer where a portion of the swell-inducing fluid may be retained. The swell-inducing fluid may be the same or a different fluid than the reaction-inducing fluid. The swell-inducing fluid may continue to diffuse into the swellable elastomer, causing the washout prevention element 105 to swell until they contact an adjacent surface. The washout prevention element 105 may work in tandem with the expandable metal sealing element 10 to create a differential seal around the conduit 15.

Figure 7:
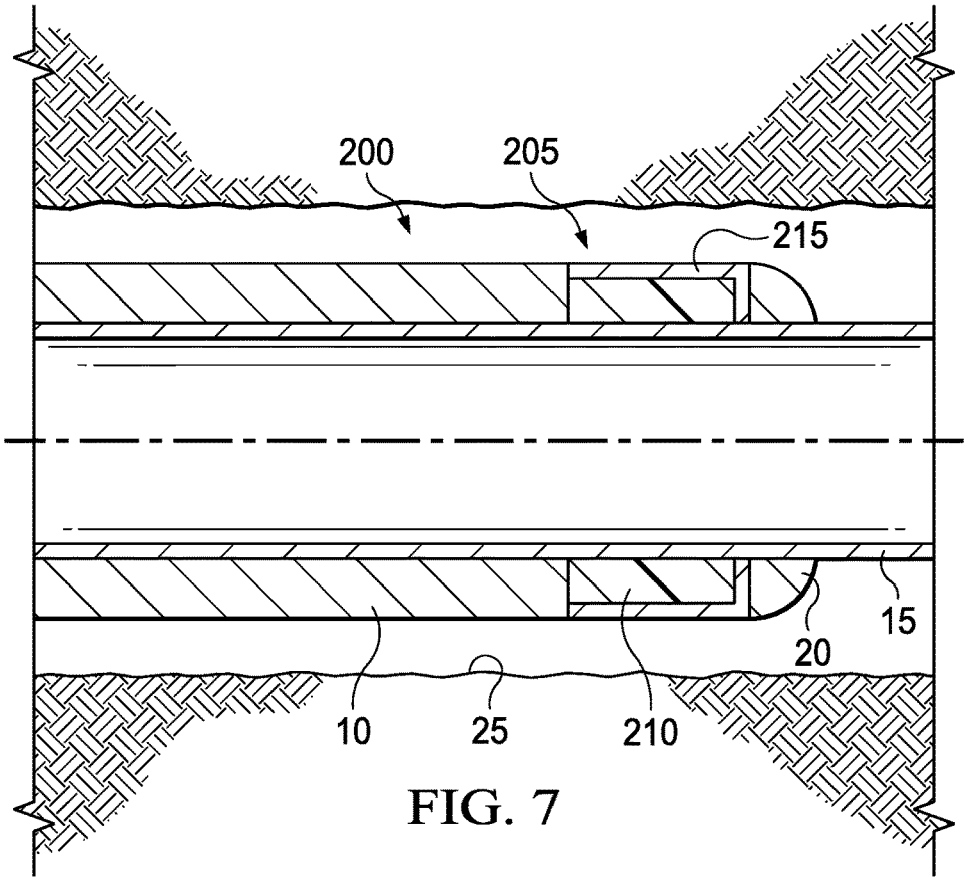
FIG. 7 is a cross-section illustration of another example wellbore sealing system in accordance with the examples disclosed herein.

FIG. 7 is a cross-section illustration of an example wellbore sealing system 200. Wellbore sealing system 200 comprises an expandable metal sealing element 10 disposed on a conduit 15. The expandable metal sealing element 10 may be held in place on the conduit 15 with end rings 20. End rings 20 are optional and may be substituted for other elements sufficient to maintain the expandable metal sealing element 10 in position when the conduit 15 is introduced downhole. Alternatively, the expandable metal sealing element 10 may be held in place with set screws or may be disposed in a recess precluding the need for any species of retaining ring. Conduit 15 may be any species of wellbore conduit and may comprise production tubing, drillpipe, liner, liner hanger, etc. The expandable metal sealing element 10 may seal against surface 25. Surface 25 is proximate to the expandable metal sealing element 10. Surface 25 may be the exterior surface of another conduit, a downhole tool, the wall of the subterranean formation, or a set cement layer. Washout prevention element 205 is located downstream of the expandable metal sealing element 10. In the illustrated example, the washout prevention element 205 is positioned on one side of the expandable metal sealing element 10 in the downstream direction. In some other examples, the washout prevention element 205 may be positioned upstream of the expandable metal sealing element 10. In some examples, a washout prevention element 205 may be positioned on both sides of the expandable metal sealing element 10 when bi-directional flow is anticipated. The washout prevention element 205 comprises an absorbent polymer 210 restrained by a degradable restraint 215. The washout prevention element 205 is actuated by degradation of the restraint 215 to release the absorbent polymer 210. The released absorbent polymer 210 would swell to fill the surrounding space and prevent washout of the reaction products.

The degradable restraint 215 may comprise any species of degradable material including degradable metals and polymeric materials. The degradable restraint 215 is illustrated as a shell which surrounds the absorbent polymer 210. In the illustrated example, the degradable restraint 215 contacts the expandable metal sealing element 210. In alternative examples, the degradable restraint 215 may be integrated with the expandable metal sealing element 10 and may be a discrete element that completely surrounds the absorbent polymer 210. The degradable restraint 215 may degrade over time in the wellbore environment or may be actively degraded chemically with a wellbore fluid, acid, or a solvent. The degradable restraint 215 may comprise any degradable material including, but not limited to, a dissolvable salt, a dissolvable metal, a eutectic material, a degradable plastic, and any combination of materials. In some examples, the degradable restraint 215 may comprise a different reactive metal than the expandable metal sealing element 10, and specifically may comprise a reactive metal that reacts at a faster rate than the reactive metal of the expandable metal sealing element 10. The degradable restraint 215 may be configured to comprise a degradable material that is removed faster than the reaction rate of the expandable metal sealing element 10. As such, the degradable restraint is removed at a sufficiently fast rate to allow the washout prevention element 205 to actuate in position to prevent the washout of the reaction products.

The absorbent polymer 210 comprises any species of absorbent polymer and/or superabsorbent polymer. Examples of the absorbent polymer 210 include, but are not limited to, polyacrylamide, polyvinyl alcohol; polysaccharides; acrylic acid; acrylamide; polyethylene oxide; polyacrylonitrile; ethylene maleic anhydride; carboxymethylcellulose; sodium polyacrylate; poly(lactic acid); a poly (orthoester); polybutylene succinate; polybutylene succinate-co-adipate; polyhydroxybutyrate-valerate; polyhydroxybutyrate-covalerate; polycaprolactone; a polyester amide; a starch-based polymer; a polyethylene terephthalate-based polymer; sulfonated polyethylene terephthalate; polyethylene; polypropylene; an aliphatic aromatic copolyester; modified cellulose; a modified lignocellulose; a modified polysaccharide; a mixture of a poly(vinylamine) polymer and polyacrylic acid; polyvinyl ether; hydroxypropylcellulose; polyvinyl morpholinone; a polymer or copolymer of vinyl sulfonic acid; polyacrylate; polyacrylamide; polyvinyl pyridine; a hydrolyzed acrylonitrile grafted starch; an acrylic acid grafted starch; an isobutylene maleic anhydride copolymer; polyphosphazene; and any combination.

Figure 8:
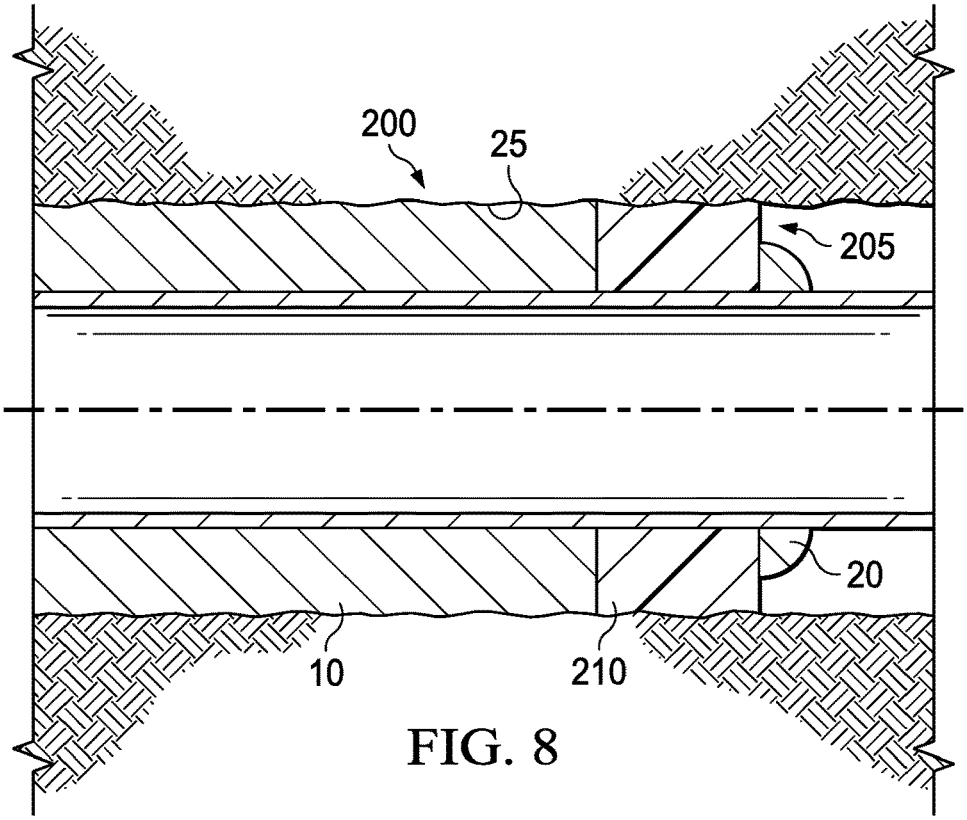
FIG. 8 is a cross-section illustration of the wellbore sealing system of FIG. 7 after expansion of the expandable metal sealing element and the release and absorption of a fluid by the absorbent polymers in accordance with the examples disclosed herein.

FIG. 8 is a cross-section illustration of the wellbore sealing system 200 of FIG. 7 after expansion of the expandable metal sealing element 10 and the release and absorption of a fluid by the absorbent polymers 210. The absorbent polymers 210 may absorb a fluid to expand in size. The expansion of the absorbent polymers 210 blocks the washout of the reaction products. The absorbent polymers 210 may expand through absorption of the reaction-inducing fluid or a different fluid. The absorbent polymers 210 may degrade over time in some examples, or may be permanent. The absorbent polymers 210 may also work in tandem with the expandable metal sealing element 10 to create a differential seal around the conduit 15.

Figure 9:
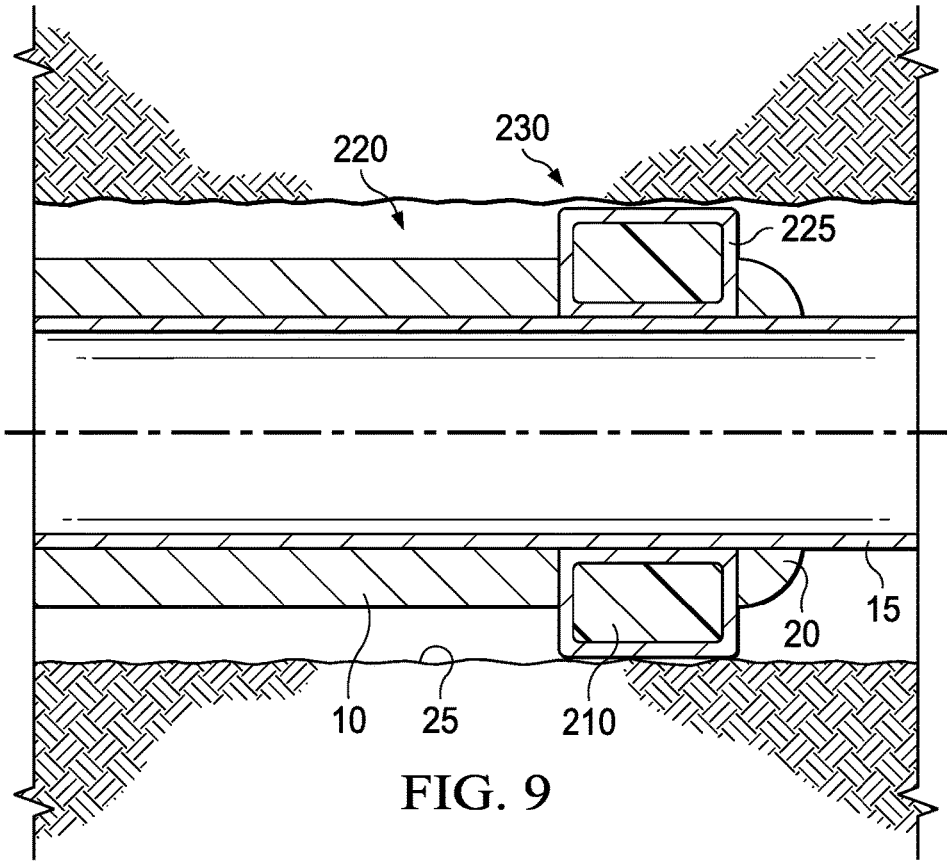
FIG. 9 is a cross-section illustration of another example wellbore sealing system in accordance with the examples disclosed herein.

FIG. 9 is a cross-section illustration of an example wellbore sealing system 220. Wellbore sealing system 220 is similar to wellbore sealing system 200 illustrated in FIGS. 7 and 8 except that it comprises washout prevention element 230. Washout prevention element 230 is similar to the washout prevention element 205 of FIGS. 7 and 8 except that it comprises a permeable bladder 225 to restrain the absorbent polymers 210 instead of the restraint 215 illustrated in FIGS. 7 and 8. Permeable bladder 225 is an expandable bladder that is permeable to a fluid that will be absorbed by the absorbent polymer 210. The fluid may enter the permeable bladder 225 where it may be absorbed by the absorbent polymers 210. As the absorbent polymers 210 absorb the fluid, they may expand in volume thereby inducing a corresponding expansion of the permeable bladder 225 which may expand to block the washout of the reaction products.

Figure 10:
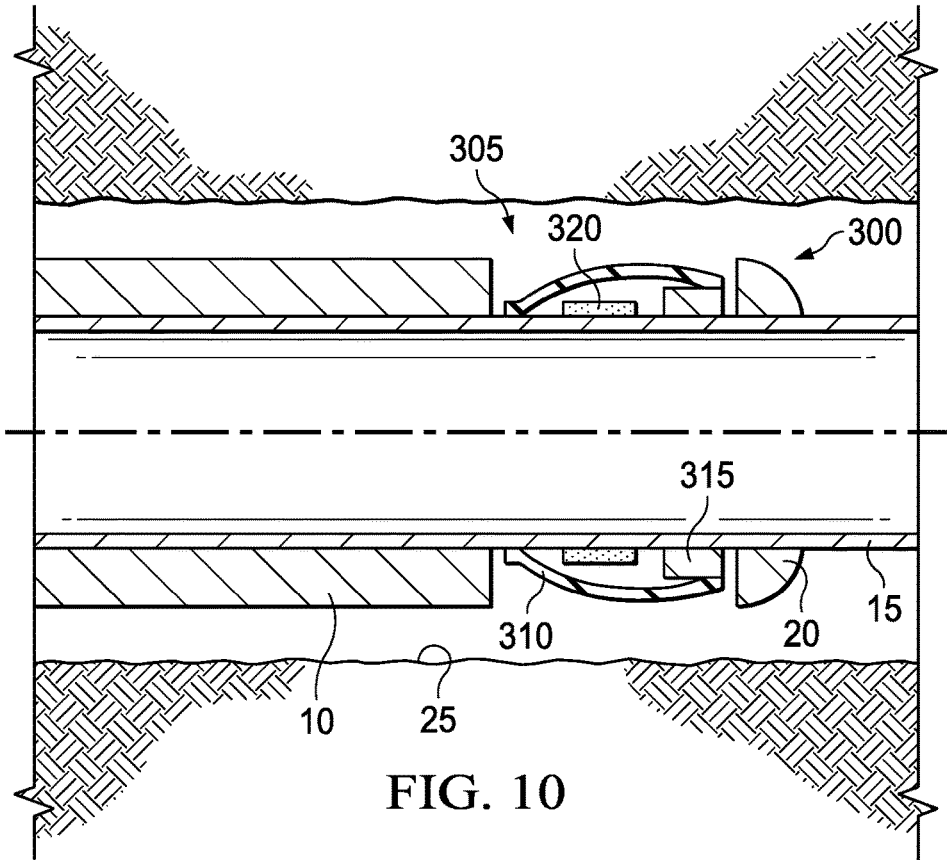
FIG. 10 is a cross-section illustration of another example wellbore sealing system in accordance with the examples disclosed herein.

FIG. 10 is a cross-section illustration of an example wellbore sealing system 300. Wellbore sealing system 300 comprises an expandable metal sealing element 10 disposed on a conduit 15. The expandable metal sealing element 10 may be held in place on the conduit 15 with end rings 20. End rings 20 are optional and may be substituted for other elements sufficient to maintain the expandable metal sealing element 10 in position when the conduit 15 is introduced downhole. Alternatively, the expandable metal sealing element 10 may be held in place with set screws or may be disposed in a recess precluding the need for any species of retaining ring. Conduit 15 may be any species of wellbore conduit and may comprise production tubing, drillpipe, liner, liner hanger, etc. The expandable metal sealing element 10 may seal against surface 25. Surface 25 is proximate to the expandable metal sealing element 10. Surface 25 may be the exterior surface of another conduit, a downhole tool, the wall of the subterranean formation, or a set cement layer. Washout prevention element 305 is located downstream of the expandable metal sealing element 10. In the illustrated example, the washout prevention element 305 is positioned on one side of the expandable metal sealing element 10 in the downstream direction. In some other examples, the washout prevention element 305 may be positioned upstream of the expandable metal sealing element 10. In some examples, a washout prevention element 305 may be positioned on both sides of the expandable metal sealing element 10 when bi-directional flow is anticipated. The washout prevention element 305 comprises an inflatable bladder 310, a one-way valve 315, and a gas-emitting material 320. The washout prevention element 305 is actuated by fluid flowing into the one-way valve 315 (e.g., a check valve). The one-way valve 315 allows fluid to flow into the inflatable bladder 310 where it may react with gas-emitting material 320 to produce a gas. The one-way valve 315 does not allow the gas to escape the inflatable bladder 310. As the gas is produced, the gas inflates the inflatable bladder 310 so that it contacts surface 25 and seals the surrounding area preventing the washout of the reaction products downstream.

Figure 11:
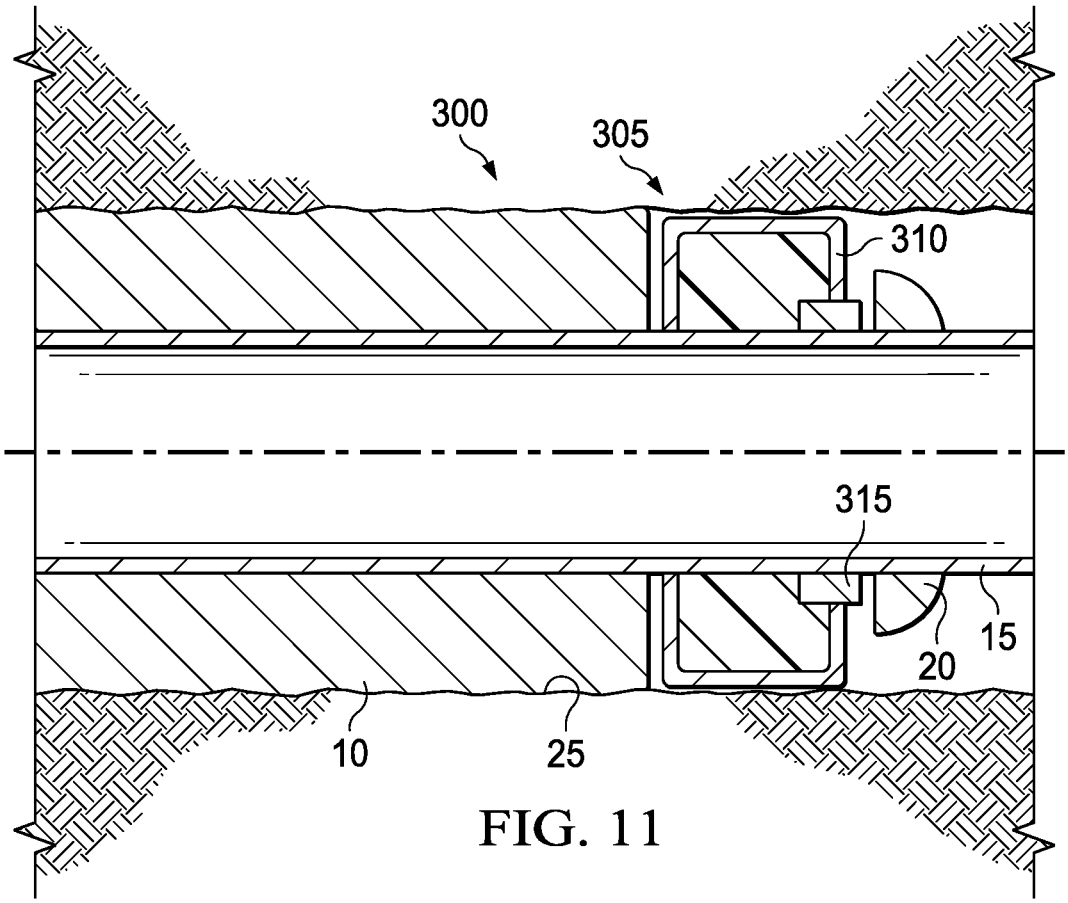
FIG. 11 is a cross-section illustration of the wellbore sealing system of FIG. 10 after expansion of the expandable metal sealing element and the inflation of the inflatable bladder in accordance with the examples disclosed herein.

FIG. 11 is a cross-section illustration of the wellbore sealing system 300 of FIG. 10 after expansion of the expandable metal sealing element 10 and the inflation of the inflatable bladder 310. The formation of gas from the reaction of the fluid and the gas-emitting material (i.e., gas-emitting material 320 as illustrated in FIG. 10) inflates the inflatable bladder 310. The inflatable bladder 310 may degrade over time in some examples, or may be permanent. The inflatable bladder 310 may also work in tandem with the expandable metal sealing element 10 to create a differential seal around the conduit 15.

The inflatable bladder 310 may comprise any material that is non-porous and is sufficient to block the crossflow of a fluid when inflated. The gas-emitting material 320 may comprise any material which may emit a gas when exposed to a fluid such as a wellbore fluid. A reactive metal such as those used in the expandable metal sealing element 10 may be selected in some examples; however, the species chosen for the gas-emitting material 320 should be a faster-reacting reactive metal than the species of reactive metal selected for the expandable metal sealing element 10. Other nonmetal materials may also be selected for the gas-emitting material 320 in alternative examples. A specific example of a gas-emitting material 320 is calcium carbonate which emits carbon dioxide gas upon reaction with some acidic aqueous fluids.

Figure 12:
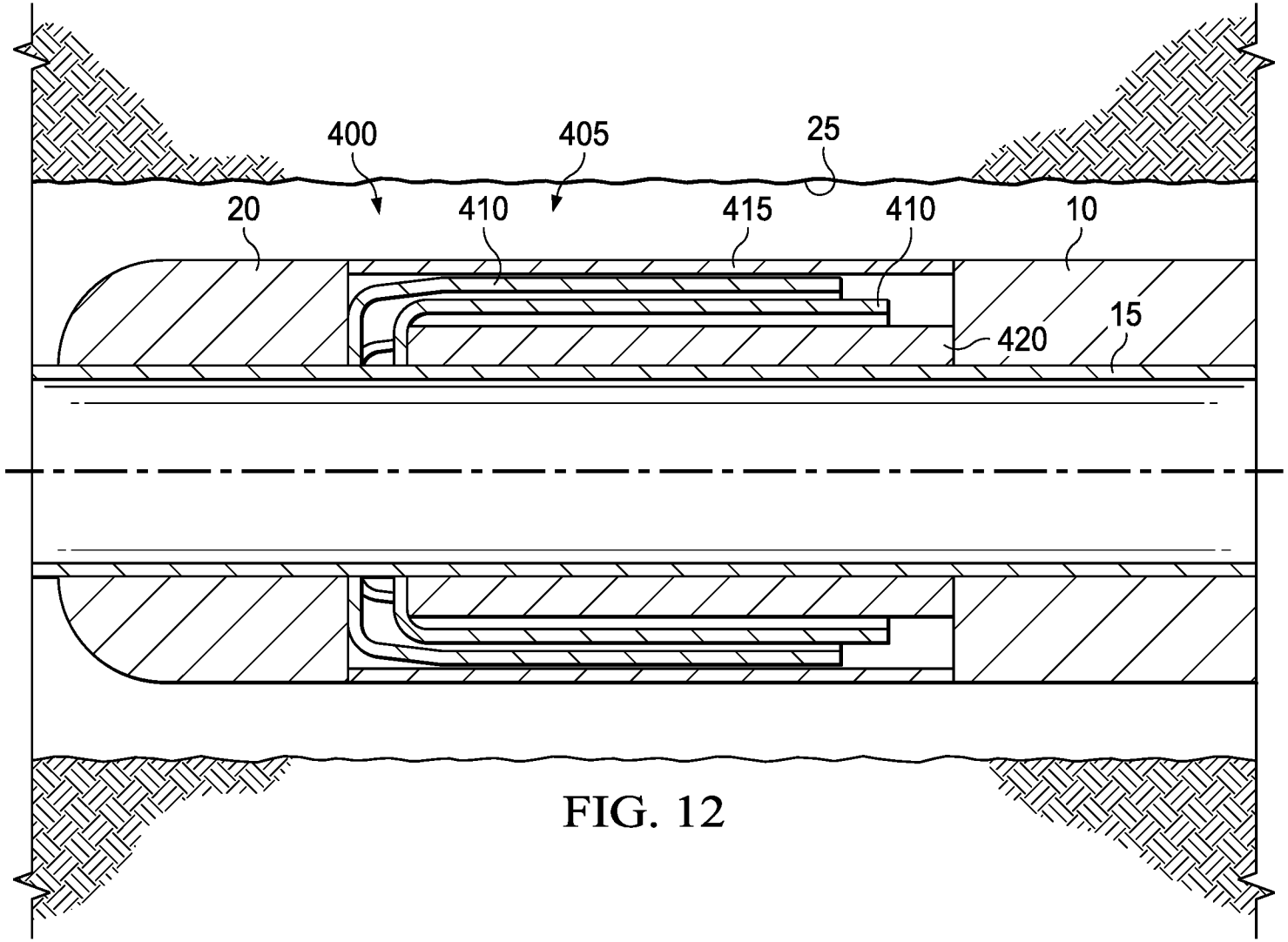
FIG. 12 is a cross-section illustration of another example wellbore sealing system in accordance with the examples disclosed herein.

FIG. 12 is a cross-section illustration of an example wellbore sealing system 400. Wellbore sealing system 400 comprises an expandable metal sealing element 10 disposed on a conduit 15. The expandable metal sealing element 10 may be held in place on the conduit 15 with end rings 20. End rings 20 are optional and may be substituted for other elements sufficient to maintain the expandable metal sealing element 10 in position when the conduit 15 is introduced downhole. Alternatively, the expandable metal sealing element 10 may be held in place with set screws or may be disposed in a recess precluding the need for any species of retaining ring. Conduit 15 may be any species of wellbore conduit and may comprise production tubing, drillpipe, liner, liner hanger, etc. The expandable metal sealing element 10 may seal against surface 25. Surface 25 is proximate to the expandable metal sealing element 10. Surface 25 may be the exterior surface of another conduit, a downhole tool, the wall of the subterranean formation, or a set cement layer. Washout prevention element 405 is located downstream of the expandable metal sealing element 10. In the illustrated example, the washout prevention element 405 is positioned on one side of the expandable metal sealing element 10 in the downstream direction. In some other examples, the washout prevention element 405 may be positioned upstream of the expandable metal sealing element 105. In some examples, a washout prevention element 405 may be positioned on both sides of the expandable metal sealing element 10 when bi-directional flow is anticipated. The washout prevention element 405 comprises at least two rows of petals 410, a degradable restraint 415, and an internal expandable metal sealing element 420. The washout prevention element 405 is actuated by degrading the degradable restraint 415 to release the rows of petals 410. The rows of petals 410 are compressed in the present illustration, but are biased so that they spring outward. The rows of petals 410 are offset from one another such that the gap between individual petals are blocked by the petals 410 of the adjacent row. The released rows of petals 410 contact surface 25 and capture the reaction products preventing them from washing out.

The degradable restraint 415 may comprise any species of degradable material including degradable metals and polymeric materials. The degradable material may include, but is not limited to, a dissolvable salt, a dissolvable metal, a eutectic material, a degradable plastic, and any combination of materials. The degradable restraint 415 is illustrated as a shell which surrounds the compressed rows of petals 410. The degradable restraint 415 may degrade over time in the wellbore environment or may be actively degraded chemically with a wellbore fluid, acid, or a solvent. In some examples, the degradable restraint 415 may comprise a different reactive metal than the expandable metal sealing element 10, and specifically may comprise a reactive metal that reacts at a faster rate than the reactive metal of the expandable metal sealing element 10. The degradable restraint 415 may be configured to comprise a degradable material that is removed faster than the reaction rate of the expandable metal sealing element 10. As such, the degradable restraint 415 is removed at a sufficiently fast rate to allow the washout prevention element 405 to actuate in position to prevent the washout of the reaction products.

The internal expandable metal sealing element 420 is an optional element of the washout prevention element 405. In some examples, the washout prevention element 405 may not comprise the internal expandable metal sealing element 420. The internal expandable metal sealing element 420 comprises a reactive metal such as those used in the expandable metal sealing element 10; however, the species chosen may be a faster-reacting reactive metal than the species of reactive metal selected for the expandable metal sealing element 10. Alternatively, the species chosen for the reactive metal may be the same as or comprise a similar reaction rate as the reactive metal selected for the expandable metal sealing element 10.

In some alternative examples, the fast-reacting internal expandable metal sealing element 420 may be replaced with an open-cell foam or a metallic mesh to provide contact surfaces for the aggregation of the reaction products. In these examples, the open-cell foam or a metallic mesh may be compressed and may expand in volume upon degradation of the degradable restraint 415 and the release of the rows of petals 410.

Figure 13:
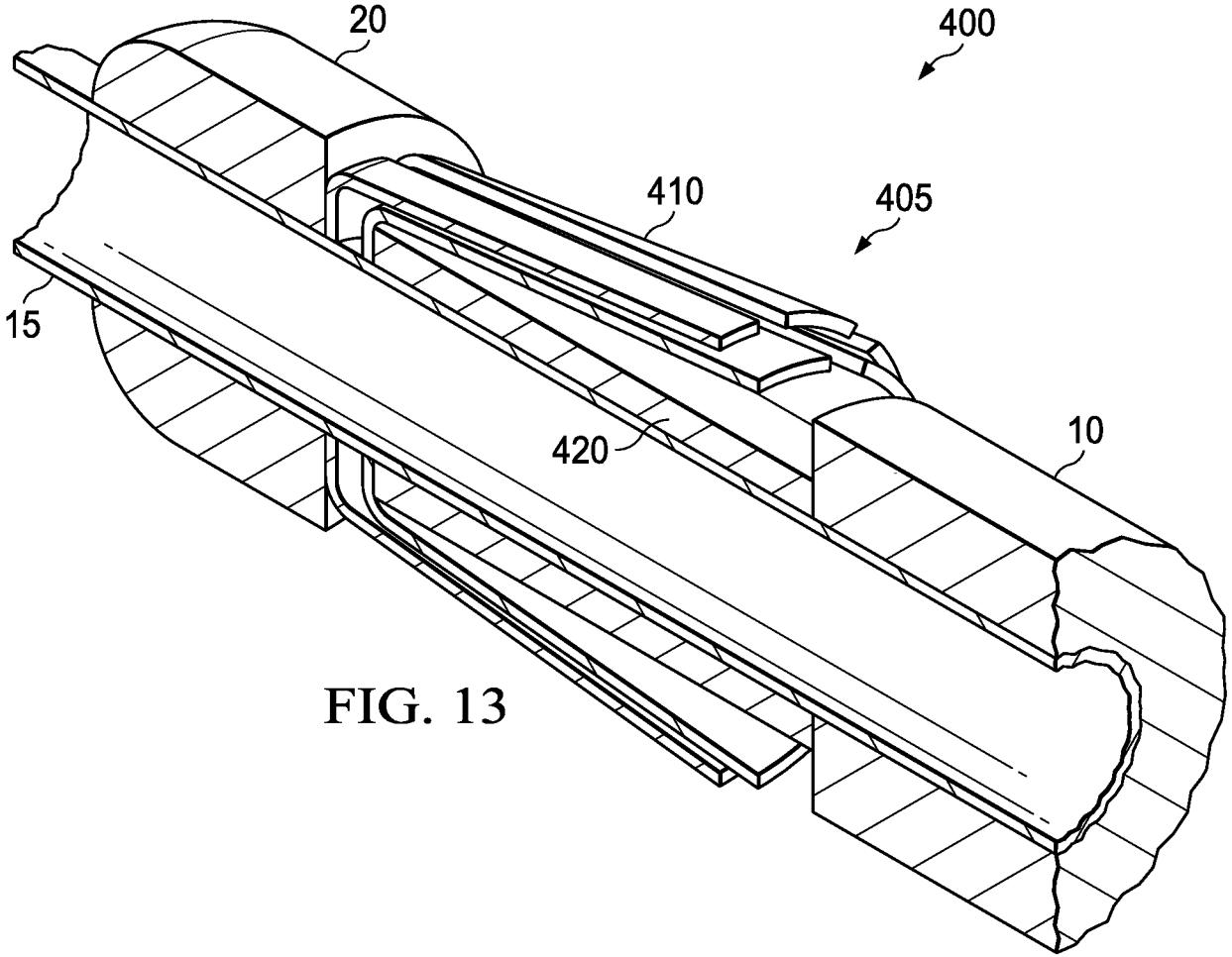
FIG. 13 is an isometric illustration of the wellbore sealing system of FIG. 12 after degradation of the degradable restraint and the release of the rows of petals in accordance with the examples disclosed herein.

FIG. 13 is an isometric illustration of the wellbore sealing system 400 of FIG. 12 after degradation of the degradable restraint 415 and the release of the rows of petals 410. The rows of petals 410 are biased radially and may spring outward. The rows of petals 410 may degrade over time in some examples, or may be permanent. The rows of petals 410 may also work in tandem with the expandable metal sealing element 10 to create a differential seal around the conduit 15.

It should be clearly understood that the examples illustrated by FIGS. 1-13 are merely general applications of the principles of this disclosure in practice, and a wide variety of other examples are possible. Therefore, the scope of this disclosure is not limited in any manner to the details of any of the FIGURES described herein.

It is also to be recognized that the systems may also directly or indirectly affect the various downhole equipment and tools that may come into contact with the systems during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in any of the FIGURES.

Provided are methods for forming a seal in a wellbore in accordance with the disclosure and the illustrated FIGURES. An example method comprises positioning an expandable metal sealing element in the wellbore; wherein the expandable metal sealing element comprises a reactive metal and is disposed in a location. The method further comprises actuating a washout prevention element, contacting the expandable metal sealing element with a fluid that reacts with the reactive metal to produce a reaction product having a volume greater than the reactive metal, and allowing the washout prevention element to prevent at least a portion of the reaction product from flowing away from the location.

Additionally or alternatively, the method may include one or more of the following features individually or in combination. The washout prevention element may comprise a cup seal. The washout prevention element may comprise a swellable elastomer. The washout prevention element may comprise an absorbent polymer. The washout prevention element may comprise a bladder. The washout prevention element may comprise an inflatable bladder and a gas-emitting material. The washout prevention element may comprise two rows of petals. The reactive metal may comprise a metal selected from the group consisting of magnesium, calcium, aluminum, tin, zinc, beryllium, barium, manganese, and any combination thereof. The reactive metal may comprise a metal alloy selected from the group consisting of magnesium-zinc, magnesium-aluminum, calcium-magnesium, aluminum-copper, and any combination thereof.

Provided are wellbore sealing apparatus for forming a seal in a wellbore in accordance with the disclosure and the illustrated FIGURES. An example apparatus comprises an expandable metal sealing element comprising a reactive metal and disposed downhole in a location, wherein the reactive metal is reactive with a fluid to produce a reaction product having a volume greater than the reactive metal; and a washout prevention element actuatable to prevent at least a portion of the reaction product from flowing away from the location.

Additionally or alternatively, the apparatus may include one or more of the following features individually or in combination. The washout prevention element may comprise a cup seal. The washout prevention element may comprise a swellable elastomer. The washout prevention element may comprise an absorbent polymer. The washout prevention element may comprise a bladder. The washout prevention element may comprise an inflatable bladder and a gas-emitting material. The washout prevention element may comprise two rows of petals. The reactive metal may comprise a metal selected from the group consisting of magnesium, calcium, aluminum, tin, zinc, beryllium, barium, manganese, and any combination thereof. The reactive metal may comprise a metal alloy selected from the group consisting of magnesium-zinc, magnesium-aluminum, calcium-magnesium, aluminum-copper, and any combination thereof.

Provided are systems for forming a seal in a wellbore in accordance with the disclosure and the illustrated FIGURES. An example system comprises an expandable metal sealing element comprising a reactive metal and disposed on a conduit in a location, wherein the reactive metal is reactable with a fluid to produce a reaction product having a volume greater than the reactive metal, a washout prevention element and actuatable to prevent at least a portion of the reaction product from flowing away from the location, and the conduit disposed in the wellbore.

Additionally or alternatively, the system may include one or more of the following features individually or in combination. The washout prevention element may comprise a cup seal. The washout prevention element may comprise a swellable elastomer. The washout prevention element may comprise an absorbent polymer. The washout prevention element may comprise a bladder. The washout prevention element may comprise an inflatable bladder and a gas-emitting material. The washout prevention element may comprise two rows of petals. The reactive metal may comprise a metal selected from the group consisting of magnesium, calcium, aluminum, tin, zinc, beryllium, barium, manganese, and any combination thereof. The reactive metal may comprise a metal alloy selected from the group consisting of magnesium-zinc, magnesium-aluminum, calcium-magnesium, aluminum-copper, and any combination thereof.

The preceding description provides various examples of the apparatus, systems, and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of" or "consist of the various components and steps." Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A method for forming a seal in a wellbore comprising:

positioning an expandable metal sealing element in the wellbore; wherein the expandable metal sealing element comprises a reactive metal and is disposed in a location, actuating a washout prevention element by degrading a degradable restraint restraining the washout prevention element, wherein actuating the washout prevention element expands the diameter of the washout prevention element within the wellbore to make contact with an adjacent surface, wherein the degradable restraint comprises a degradable material different from the reactive metal; wherein the degradable material is selected to degrade at a faster rate than the reaction rate of the reactive metal with the fluid;

contacting the expandable metal sealing element with a fluid that reacts with the reactive metal to produce a reaction product having a volume greater than the reactive metal, and allowing the washout prevention element to prevent at least a portion of the reaction product from flowing away from the location.

2. The method of claim 1, wherein the washout prevention element comprises a cup seal.

3. The method of claim 1, wherein the washout prevention element comprises a swellable elastomer.

4. The method of claim 1, wherein the washout prevention element comprises an absorbent polymer.

5. The method of claim 4, wherein the washout prevention element further comprises a bladder.

6. The method of claim 1, wherein the washout prevention element comprises an inflatable bladder and a gas-emitting material.

7. The method of claim 1, wherein the washout prevention element comprises two rows of petals.

8. The method of claim 1, wherein the reactive metal comprises a metal selected from the group consisting of magnesium, calcium, aluminum, tin, zinc, beryllium, barium, manganese, and any combination thereof.

9. The method of claim 1, wherein the reactive metal comprises a metal alloy selected from the group consisting of magnesium-zinc, magnesium-aluminum, calcium-magnesium, aluminum-copper, and any combination thereof.

10. A sealing apparatus for a wellbore, the apparatus comprising:

an expandable metal sealing element comprising a reactive metal and disposed downhole in a location, wherein the reactive metal is reactive with a fluid to produce a reaction product having a volume greater than the reactive metal; and a washout prevention element actuatable to prevent at least a portion of the reaction product from flowing away from the location; wherein actuation of the washout prevention element expands the diameter of the washout prevention element within the wellbore to make contact with an adjacent surface;

a degradable restraint restraining the washout prevention element and preventing expansion until the restraint is degraded; wherein the degradable restraint comprises a degradable material different from the reactive metal; wherein the degradable material is selected to degrade at a faster rate than the reaction rate of the reactive metal with the fluid.

11. The apparatus of claim 10, wherein the washout prevention element comprises a cup seal.

12. The apparatus of claim 10, wherein the washout prevention element comprises a swellable elastomer.

13. The apparatus of claim 10, wherein the washout prevention element comprises an absorbent polymer.

14. The apparatus of claim 13, wherein the washout prevention element further comprises a bladder.

15. The apparatus of claim 10, wherein the washout prevention element comprises an inflatable bladder and a gas-emitting material.

16. The apparatus of claim 10, wherein the washout prevention element comprises two rows of petals.

17. A system for forming a seal in a wellbore, the system comprising:

an expandable metal sealing element comprising a reactive metal and disposed on a conduit in a location, wherein the reactive metal is reactable with a fluid to produce a reaction product having a volume greater than the reactive metal, a washout prevention element and actuatable to prevent at least a portion of the reaction product from flowing away from the location; wherein actuation of the washout prevention element expands the diameter of the washout prevention element within the wellbore to make contact with an adjacent surface, a degradable restraint restraining the washout prevention element and preventing expansion until the restraint is degraded, wherein the degradable restraint comprises a degradable material different from the reactive metal; wherein the degradable material is selected to degrade at a faster rate than the reaction rate of the reactive metal with the fluid; and the conduit disposed in the wellbore.

18. The system of claim 17, wherein the washout prevention element comprises a cup seal.

19. The system of claim 17, wherein the washout prevention element comprises an inflatable bladder and a gas-emitting material.

20. The system of claim 17, wherein the washout prevention element comprises two rows of petals.

* * * * *